US005809864A

United States Patent [19]

Ashton

[11] Patent Number: 5,809,864

[45] Date of Patent: Sep. 22, 1998

[54] OPPOSED PISTON ENGINES

[75] Inventor: John Ashton, Newport, United Kingdom

[73] Assignee: JMA Propulsion Ltd., Isle of Wight, United Kingdom

[21] Appl. No.: 428,171

[22] PCT Filed: Oct. 22, 1993

[86] PCT No.: PCT/GB93/02180

§ 371 Date: Jun. 12, 1995

§ 102(e) Date: Jun. 12, 1995

[87] PCT Pub. No.: WO94/10424

PCT Pub. Date: May 11, 1994

[30] Foreign Application Priority Data

Oct. 24, 1992 [GB] United Kingdom ..... 9222371

[51] Int. Cl.[6] ..... F01B 7/02

[52] U.S. Cl. ..... 92/69 R; 92/140; 92/76; 123/53.3

[58] Field of Search ..... 92/50, 68, 69 R, 92/69 B, 138, 75, 140, 76; 123/53.3, 51 R, 51 B, 197.4

[56] References Cited

U.S. PATENT DOCUMENTS

| | | | |
|---|---|---|---|
| 2,561,261 | 7/1951 | Zecher | 123/51 |
| 2,653,484 | 9/1953 | Zecher | 92/69 B |
| 3,474,768 | 10/1969 | Anesetti | 123/53.3 |

FOREIGN PATENT DOCUMENTS

| | | | |
|---|---|---|---|
| 513219 | 3/1954 | Belgium | 123/53.2 |

OTHER PUBLICATIONS

International Search Report Jan. 14, 1994.

*Primary Examiner*—Thomas E. Denion

*Attorney, Agent, or Firm*—McCormick, Paulding & Huber

[57] ABSTRACT

An opposed piston engine (10) comprising upper (12) and lower (14) cylinders and opposed pairs of pistons (16, 18) slidable therein and interconnected by rocker pivots (24, 26). A crankshaft (56) coupled to the rocker pivots (24, 26) constrains the movement of the pistons (16, 18) and is disposed with the crankshaft axis (58) intersecting the axis (44) of one of the cylinders (12, 14), whereby the geometry of the engine (10) is significantly changed thereby reducing torsional vibration and enabling a two stroke diesel version of the engine to be used as a power source for an aircraft propeller.

6 Claims, 6 Drawing Sheets

OPPOSED PISTON ENGINES

FIELD OF THE INVENTION

This invention relates to opposed piston engines. Particularly, but not exclusively, the invention relates to opposed piston internal combustion engines, but the invention may be applicable to engines powered by a source of pressurised gas or vapour.

BACKGROUND INFORMATION

An important aspect of the invention relates to opposed piston diesel engines, but the invention is not restricted thereto. The use of opposed pistons in a diesel engine enables two-stroke operation to be obtained, whereby the output power of the engine is significantly increased, thereby off-setting to some extent the inherent weight disadvantage of a diesel engine.

However, certain previous proposals in relation to opposed piston two-stroke engines have suffered from significant disadvantages, notably their complexity, weight, and inability in some cases to operate at reasonably high rates of rotation. Accordingly, such engines are inherently unsuitable for application to propeller-driven aircraft, and indeed to outboard motor uses. Other prior proposals are subject to limitations in the sequence of events during use, as explained below.

Examples of prior patents disclosing the concepts discussed above include the following:

GB 539231 (Goodman)

GB 183501 (Enderby)

GB 165861 (Vickers)

GB118135 (Penning)

EP A1 0122299 (Audi)

WO A1 81/03203 (Finley)

U.S. Pat. No. 4,869,212 (Sverdlin).

While these prior proposals disclose the overall general disposition of pistons and connecting levers, it is found when a study is made of the geometries of the prior disclosures, that important operating problems arise. For example, we have discovered that as a consequence of the crankshaft axis passing through the centre line between the upper and lower cylinders, (see GB 539,231 FIG. 3), it is impossible to obtain symmetrical events between the cylinders, in terms of the cylinder charging and firing sequence.

Additionally, the geometry of this prior proposal leads to the fact that the accuracy of the top dead centre position relates to the length of the connecting rods. Also, if both big-ends are on one crank pin the resulting diagonal connection arrangement leads to rocking couples applied thereto and strange angular accelerations, which are disadvantages. Likewise, we have established that you cannot obtain symmetrical events in the two cylinders with the previously proposed crankshaft disposition. Broadly speaking, this is due to the fact that the acceleration of the pistons varies between the two cylinders, due to the angularity of the connecting rods, and this is very critical to engine operation, particularly for a two-stroke engine.

Arising from this, we have established that with the general engine layout and disposition of the prior proposals, it is relatively straightforward to arrange that the sequence of events for one cylinder is satisfactory, but that for the other it is not. When an attempt is made to compromise, this can only be done, we have found, at the expense of altering the angular accelerations of the relevant components, thereby resulting in unsatisfactory operating sequences.

There is disclosed in GB 165,861 (Vickers) mentioned above an engine in accordance with the pre-characterising portion of claim 1 hereof in which the rockers are connected to the crankshaft by diagonal links D. In the embodiment of FIGS. 2 and 3, connecting rods are attached to one side of the links D and the crankshaft E is correspondingly displaced from the centre line of the engine for this reason.

There is disclosed in U.S. Pat. No. 2,561,261 (Zecher) also an engine in accordance with the pre-characterising portion of claim 1 hereof wherein the rockers interconnecting the pistons have so-called third arms 15 disposed generally inwardly of the engine and coupled to the crankshaft 18 by connecting rods 16. The axis of crankshaft 18 is offset from the central region of the engine in order to accommodate the crankshaft throw within the available space between the water jackets enclosing the pairs of upper and lower cylinders, as can be seen from FIGS. 4 and 5 of the drawings.

We have discovered that if the geometry of the engine layout is altered so that the centre line of the crankshaft is located on the centre line of the top or bottom cylinders, this alleviates the short-comings identified above. For use in aircraft engines, the centre line of the crankshaft is disposed on the centre line of the top cylinder, and on the centre line of the bottom cylinder for marine applications.

SUMMARY OF THE INVENTION

According to the invention there is provided an engine as defined in the accompanying claims.

In an embodiment, an opposed piston engine comprises two pairs of opposed pistons, said pistons being disposed with their cylinder axes spaced apart and extending generally in the same direction, and link means interconnecting the pistons and a rotary crankshaft. The engine is characterised by the feature that the axis of the crankshaft is located on the axis of said one cylinder.

In the embodiment, said link means comprises a pair of rocker pivots mounted for angular movement at spaced locations between the axes of the cylinders. Links extend between the rocker pivots and the pistons.

Further in the embodiment, the link means comprises axially-extending shaft means on each of said rocker pivots with crank means connected to said shaft means and spaced from said rocker, and a connecting link being provided between each of said crank means and said crank shaft.

In the embodiment, the geometry of the crankshaft disposition and power output arrangements are such as to provide the advantages of more symmetrical phasing of port events, more symmetrical phasing of injection ignition points, and more symmetrical velocities of both pairs of pistons, leading to enhanced engine balancing, and more symmetrical piston accelerations, or at least some of these features.

Associated advantages are provided by the embodiment including late injection, reduced piston friction, arising from minimal angularity of the piston rods, improved torque characteristics due to crankshaft lead, reduced torsional vibration, a raised or lowered propeller thrust line with respect to engine bulk, without the necessity for gears on the crank. These features arise directly, or indirectly through the concept of providing the centre line of the crankshaft on or close to the centre line of one of the pairs of cylinders. The upper disposition is chosen for aircraft engines, and the lower one for marine engines.

A notable aspect of the use of a diesel engine in relation to propeller-driven aircraft, we have discovered, concerns the need to minimise torsional vibrations introduced into the propeller by the engine itself.

These torsional vibration loadings arise from various sources including loads originating from firing, compression, and inertia. Firing and compression loadings arise during the firing and compression strokes.

An object of this aspect of the present invention is to provide improvements in relation to one or more of the matters discussed above, notably the provision of an opposed piston engine operating with reduced torsional vibration characteristics and/or such an engine in the form of a two-stroke diesel engine and/or the use of such an engine in relation to driving the propeller of an aircraft.

A further aspect of the invention relates to the use of the engine for driving the propeller of an aircraft. Whereas the performance of petrol engines for this purpose is significantly affected by the air density, and therefore power output tends to decrease with aircraft height, in the case of the use of a diesel engine the requirement for a predetermined ratio of air to fuel does not apply, and therefore air to fuel ratios from 25 to 1 to 12 to 1 can be accepted without significant variation in engine efficiency, whereby the effect of height on engine performance is relatively insignificant.

A further aspect of the invention relates to fuel injection timing. With normal diesel engines, fuel injection takes place in the region of 25 degrees before top dead centre in order to achieve satisfactory fuel vaporisation and subsequent ignition, having regard to the conventional diesel engine piston speed characteristics. In the case of the present invention, fuel injection can occur significantly later due to maintenance of high or maximum compression for a longer period, whereby the well-known diesel engine knock is greatly reduced. This latter aspect of the invention arises from disposing the crank pins at less than 180 degrees, eg 160 to 175 degrees from each other, whereby, in use, the opposed pistons follow each other along for a short period, thereby maintaining a generally constant volume between them. This piston relationship results in one piston being, for example, 15 degrees past top dead centre when ignition occurs, whereby some useful power is immediately provided instead of the thrust being directed at the crankshaft axis.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS

Figure 1:
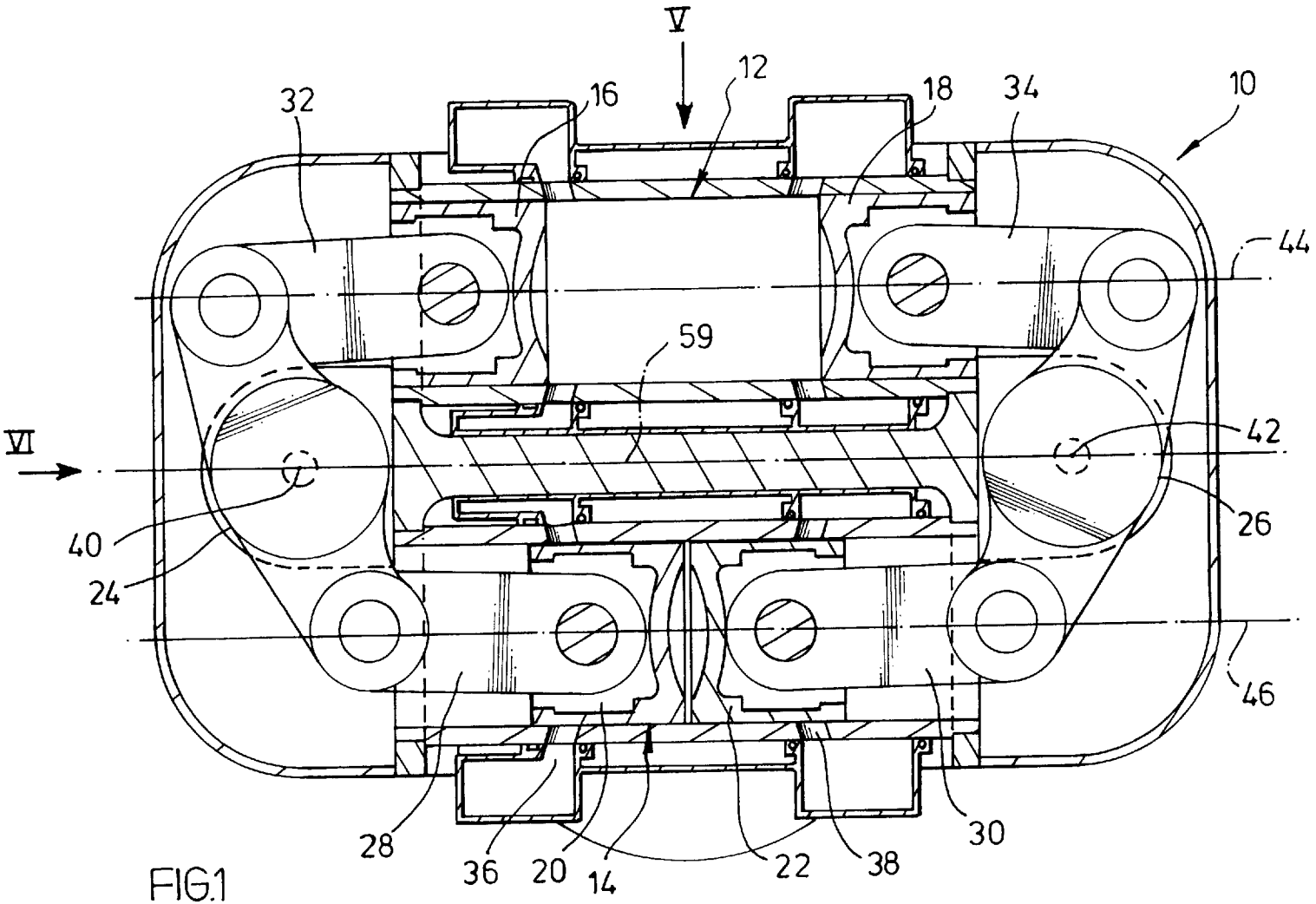
FIG. 1 shows a section through an opposed piston engine.

As shown in the drawings, an opposed piston engine 10 comprises an upper cylinder 12, a lower cylinder 14, upper pistons 16 and 18, lower pistons 20 and 22 slidable therein, rocker pivots 24 and 26, and piston links 28, 30, 32 and 34 interconnecting the rocker pivots and the pistons.

The two-stroke engine 10 has inlet ports 36 and exhaust ports 38 formed in cylinders 12 and 14.

Rocker pivots 24 and 26 are journalled on axes 40, 42 respectively. Cylinders 12 and 14 have axes 44 and 46 respectively.

Figure 2:
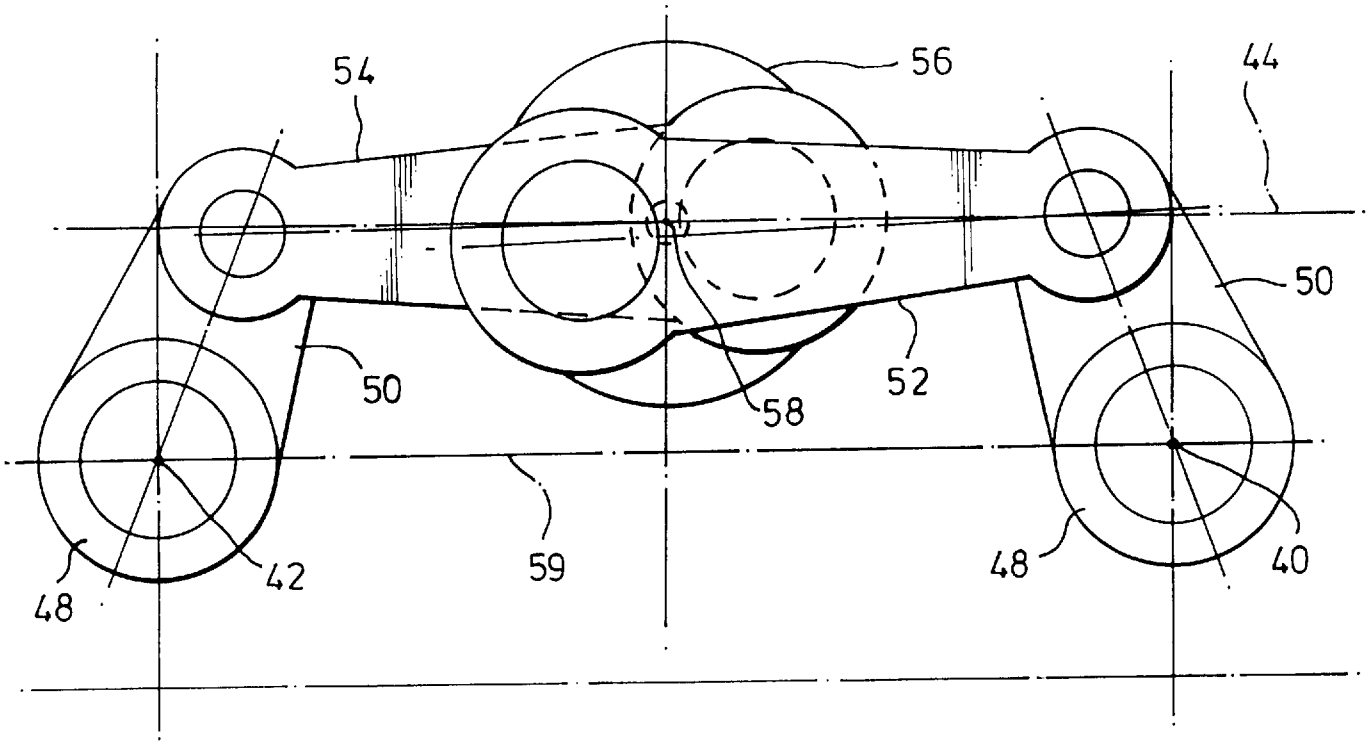
FIG. 2 shows, on a somewhat larger scale, a rear view of the engine of FIG. 1 showing the output arrangements whereby the rocker pivots are connected to the crankshaft.
Figure 3:
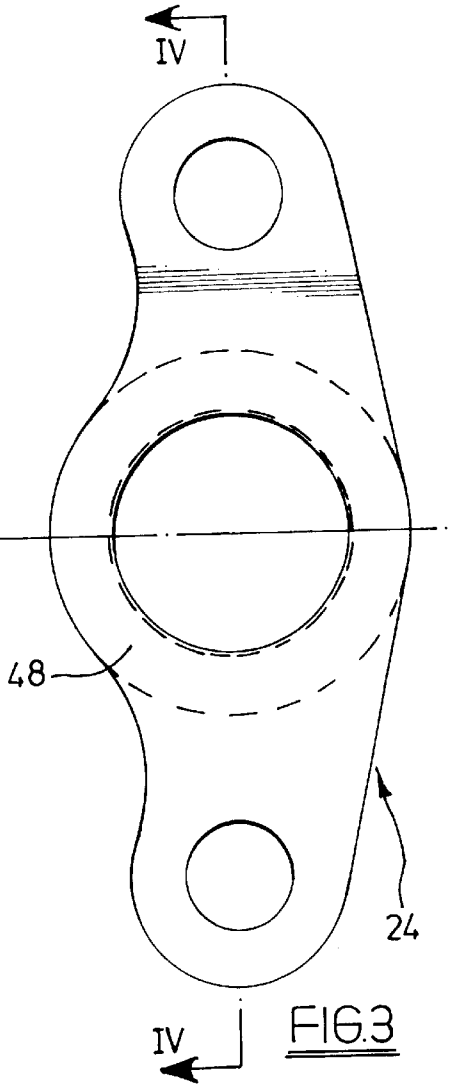
FIGS. 3 and 4 show, also on a larger scale, one of the rocket pivots, and a section therethrough, respectively.
Figure 4:
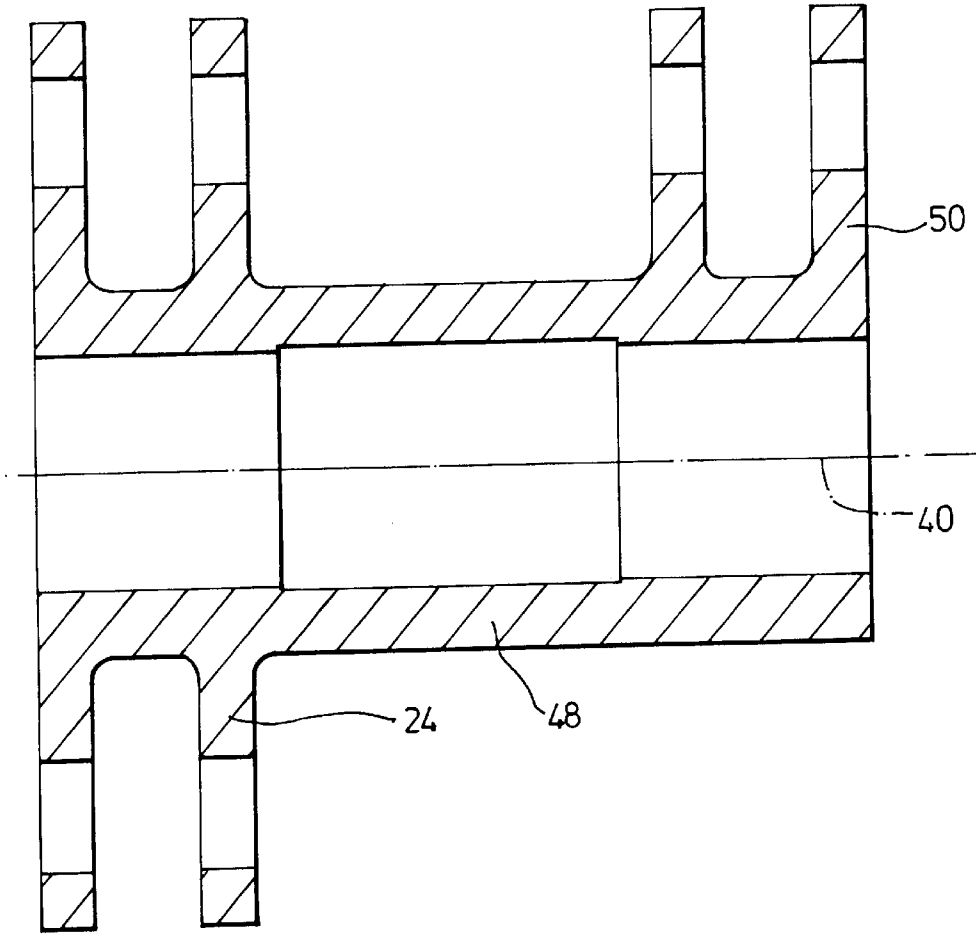

FIG. 2 shows the drive output arrangements. Each of the rocker pivots 24, 26 has a tubular shaft 48 which extends axially and carries a crank 50 at its end, as shown in FIGS. 3 and 4. The two cranks 50 are seen in FIG. 2 and are connected by crankshaft links 52, 54 to crankshaft 56.

Thus, crankshaft 56 is located on an axis 58 which actually intersects the axis 44 of cylinder 12, and thus is spaced from a line 59 extending parallel to axis 44 at the mid point between the cylinders.

In use, drive is transmitted from the pistons 16, 18, 20, 22 and through links 28, 30, 32, 34 to rocker pivots 24, 26 and through shafts 48 to cranks 50, and thence via crankshaft links 52, 54 to crankshaft 56.

The geometry of the relative dispositions of these parts, as shown in the drawings, and as more broadly described above, provides the technical advantages likewise described above in terms of symmetrical phasing of port events, and related advantages as disclosed above. These advantages can be determined from a geometric analysis of the above described engine and from an examination of its performance, but are not immediately apparent without such.

Figure 5:
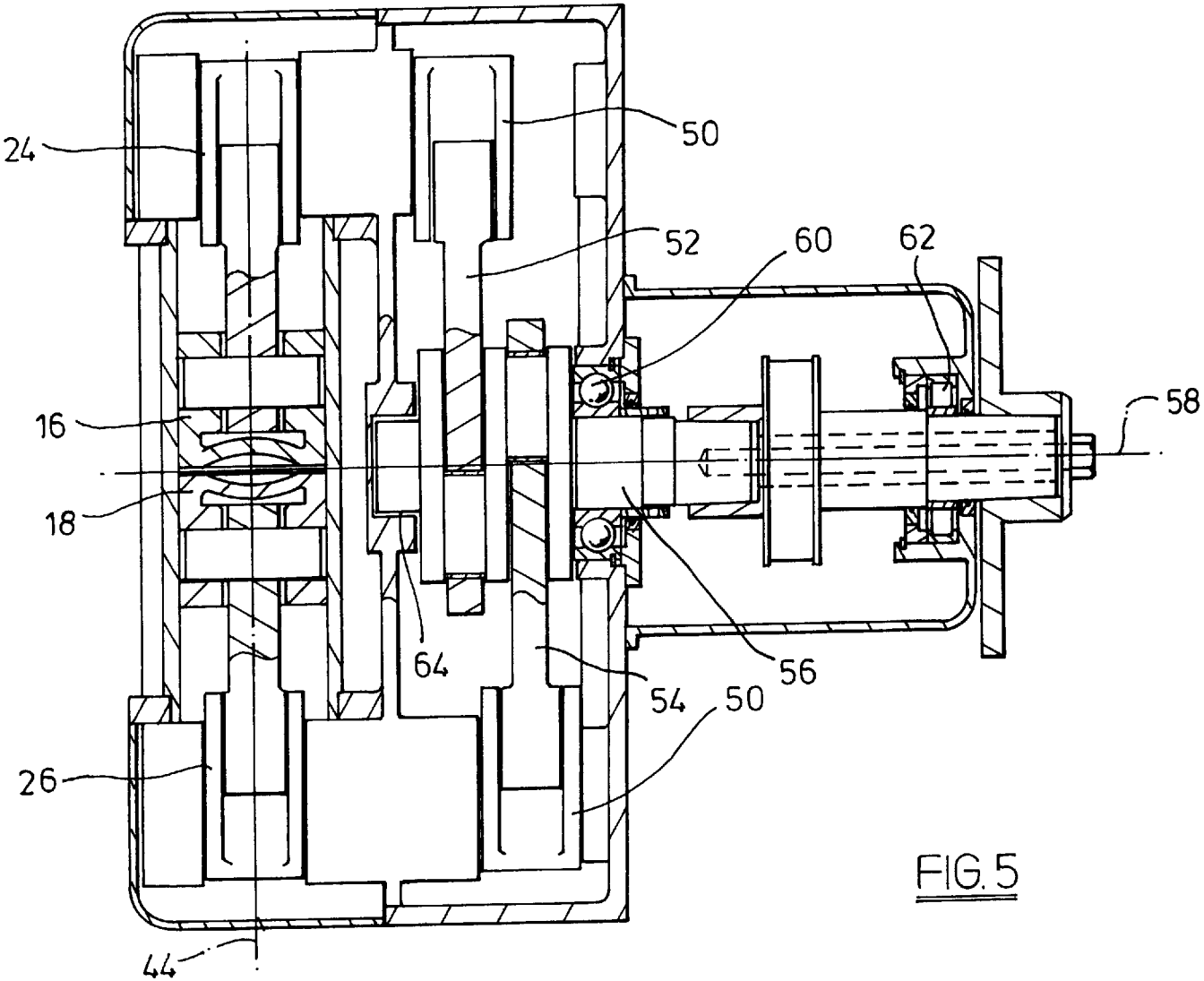
FIG. 5 shows a top view of the engine, as seen in the direction indicated by arrow V in FIG. 1, illustrating the drive output arrangements.

FIG. 5 shows crankshaft 56, and the details of its connection to other parts of the engine, as described above, in more detail, including the bearing arrangements including races 60, 62 and an end bearing 64.

Figure 6:
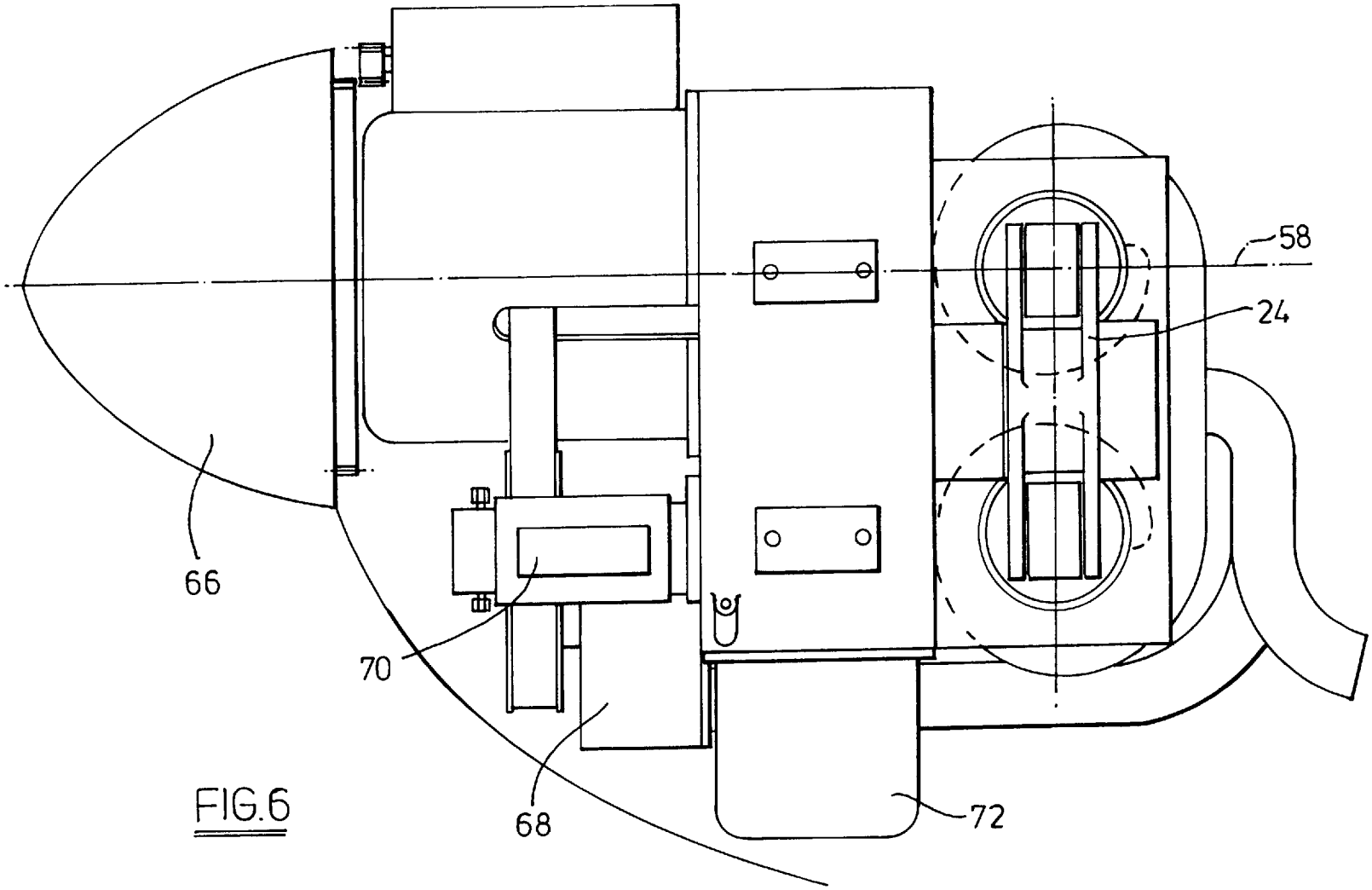
FIG. 6 shows a side elevation view in the direction indicated by arrow VI in FIG. 1.

FIG. 6 shows an aircraft application of the engine with a propeller mounting 66, a blower at 68, a fuel injection pump at 70, and the engine sump at 72.

Figure 8:
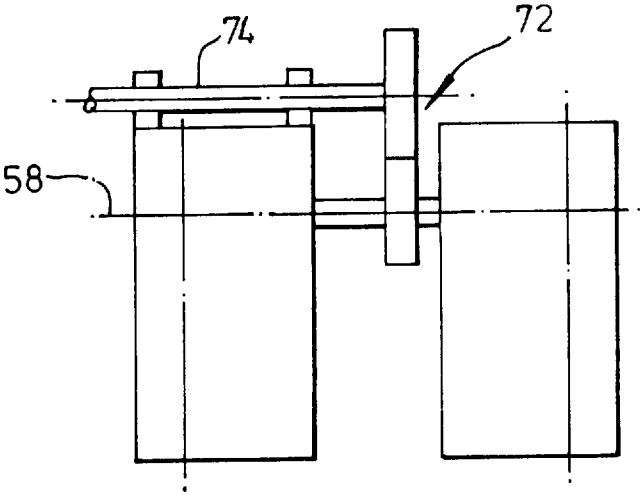
FIGS. 7 and 8 illustrate alternative gear drive output arrangements.
Figure 7:
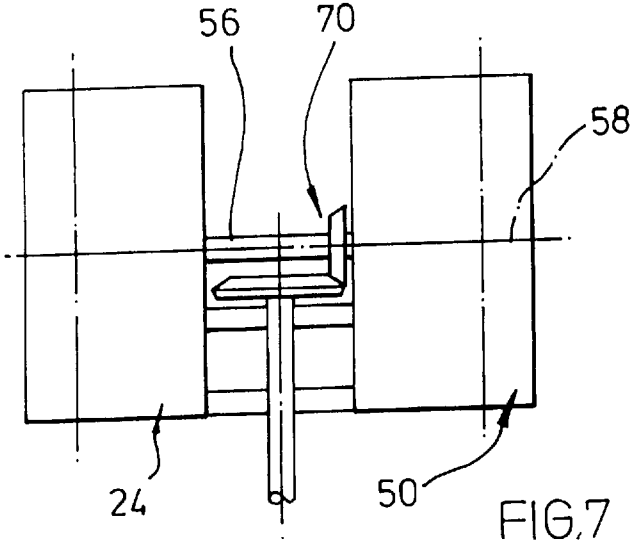

FIGS. 7 and 8 show constant mesh gear output arrangements for providing an output drive in a chosen direction. FIG. 7 shows a bevel drive 70 provided on crankshaft 56. FIG. 8 shows a straight gear drive 72 to provide an output shaft 74 disposed parallel to the crankshaft axis 58.

What is claimed is:

1. An opposed piston engine comprising:

a) first (12) and second (14) spaced cylinders with spaced cylinder axes;

b) pairs of pistons (16, 18 and 20, 22) slidable in said cylinders;

c) inlet (36) and exhaust (38) ports formed in said cylinders;

d) rockers (24, 26) pivoted about axes (40, 42) and interconnecting said pistons (16, 20 and 18, 22); and e) a crankshaft (56) drivingly coupled to said rockers for drive transmission purposes; characterised by f) the axis (58) of said crankshaft extending through the internal volume of one of said cylinders, and in the region of the inner dead-centre position of the pistons thereof.

2. An engine according to claim 1 characterised by said crankshaft (56) being coupled to said rockers (24, 26) through respective axially-extending drive shafts (48) whereby the drive paths are axially offset to one side of said one of said cylinders.

3. An engine according to claim 2 characterised by said axially-extending drive shafts (48) being coupled to said crankshaft (56) by a drive train (50, 52, 54) extending generally lengthwise of said one of said cylinders (12, 14) and then radially with respect to said drive shafts (48).

4. An engine according to claim 3 characterised by said drive train (50, 52, 54) comprising crankshaft links (52, 54) and cranks (50).

5. An engine according to claim 1 characterised by said cylinders (12, 14) of said engine being disposed one above the other, and said axis (58) of said crankshaft (56) being disposed on the axis (44) of the upper (12) of said cylinders, and said engine being an aircraft engine.

6. An engine according to claim 1 characterised by said cylinders (12, 14) of said engine being disposed one above the other, and said axis (58) of said crankshaft (56) being disposed on the axis (46) of the lower (14) of said cylinders, and said engine being a marine engine.

* * * * *